US008701542B2

(12) United States Patent
Chiappini et al.

(10) Patent No.: US 8,701,542 B2
(45) Date of Patent: Apr. 22, 2014

(54) ARTILLERY AMMUNITIONS LOADING SYSTEM

(75) Inventors: Andrea Chiappini, La Spezia (IT); Manuel D'Eusebio, La Spezia (IT)

(73) Assignee: OTO Melara S.p.A., La Spezia (IT)

( * ) Notice: Subject to any disclaimer, the term of this patent is extended or adjusted under 35 U.S.C. 154(b) by 47 days.

(21) Appl. No.: 13/292,749

(22) Filed: Nov. 9, 2011

(65) Prior Publication Data

US 2012/0111182 A1 May 10, 2012

(30) Foreign Application Priority Data

Nov. 10, 2010 (IT) ..... TO2010A0897

(51) Int. Cl.
*F41A 9/00* (2006.01)
*F41A 9/37* (2006.01)

(52) U.S. Cl.
CPC ..... *F41A 9/375* (2013.01)
USPC ..... 89/45; 89/46

(58) Field of Classification Search
CPC ..... F41A 9/16; F41A 9/21; F41A 9/38; F41A 9/13; F41A 9/14; F41A 9/06; F41A 9/11; F41A 9/22; F41A 9/375; F41F 3/0406; F41F 1/06
USPC ..... 89/45, 46
See application file for complete search history.

(56) References Cited

U.S. PATENT DOCUMENTS

| | | | | | |
|---|---|---|---|---|---|
| 2,960,009 | A | * | 11/1960 | Hereth et al. | 89/1.805 |
| 3,113,486 | A | * | 12/1963 | Kongelbeck | 89/1.802 |
| 3,122,967 | A | * | 3/1964 | Johnson et al. | 89/46 |
| 4,398,447 | A | * | 8/1983 | Harris et al. | 89/46 |
| 4,429,616 | A | * | 2/1984 | Grosser | 89/36.13 |
| 4,457,209 | A | * | 7/1984 | Scheurich et al. | 89/45 |
| 4,640,182 | A | * | 2/1987 | DeHaven et al. | 89/47 |
| H0592 | H | * | 3/1989 | Gillum | 89/46 |
| 5,831,201 | A | * | 11/1998 | Andersson et al. | 89/45 |
| 5,844,163 | A | * | 12/1998 | Lindskog | 89/46 |
| 6,460,448 | B1 | * | 10/2002 | Zangrando | 89/45 |

FOREIGN PATENT DOCUMENTS

| | | |
|---|---|---|
| EP | 0 569 341 | 11/1993 |
| EP | 0 569 342 | 11/1993 |
| WO | WO 96/12153 | 4/1996 |

OTHER PUBLICATIONS

Italian Search Report for Application No. TO20100897 mailed Aug. 17, 2011.

* cited by examiner

*Primary Examiner* — Samir Abdosh
(74) *Attorney, Agent, or Firm* — Merchant & Gould P.C.

(57) ABSTRACT

An artillery ammunition loading system (100), configured to load ammunitions includes at least one projectile in a cannon or a howitzer (11). The ammunition loading system includes a first mobile loader (102*a*) for loading projectiles and a second mobile loader (102*b*) for loading propelling charges, which alternatively and at least partially automatically feed the cannon or howitzer (11) for each firing cycle.

4 Claims, 4 Drawing Sheets

ARTILLERY AMMUNITIONS LOADING SYSTEM

This application claims benefit of Serial No. TO 2010 A 000897, filed 10 Nov. 2010 in Italy and which application is incorporated herein by reference. To the extent appropriate, a claim of priority is made to the above disclosed application.

BACKGROUND

The present invention is relative to an ammunition loading system and, in detail, it is relative to an artillery ammunition loading system.

It is known that artillery ammunition loading systems of the traditional type are designed and configured to fulfill the specific needs of a combat vehicle or a battleship and require a manual operation in order to load the ammunition.

In particular, artillery ammunitions comprise a first part, or projectile, which, in use, is the first one to be loaded into the cannon or howitzer, and a second part, or propelling charge, which is the second part to be inserted following the projectile.

Some of the loading operations for loading the ammunitions, i.e. the projectile and the propelling charge, are at least partially performed in a manual manner and, therefore, cause a delay in terms of time and a risk due to the manual handling.

As a consequence, loading operators are exposed to a plurality of risks, which comprise, at least, being subject to overpressure at the moment of the firing and the risk of exposure to contamination from ionizing particles (nuclear radiations), bacteriological or chemical agents, commonly known as NBC agents (Nuclear, Bacteriological, Chemical), as well as the risk of exposure to contaminations due to the handling of propelling material to be inserted into the breech.

Furthermore, loading operators typically work in a turret that supports the carriage of the cannon or howitzer; said turret rises above a hull both of a fighting vehicle and of a battleship. The hull typically guarantees a higher degree of protection than the turret due to the fact that operators are situated at a lower height and, therefore, their position is more hidden.

Furthermore, ammunition loading systems of the known type present great difficulties in loading the cannon or howitzer, if the latter is configured with large elevation angles.

SUMMARY

The object of the present invention is to describe an artillery ammunition loading system, which does not present the drawbacks described above.

BRIEF DESCRIPTION OF THE DRAWINGS

The invention will now be described with reference to the accompanying drawings, which illustrate a non-limiting embodiment, wherein.

DETAILED DESCRIPTION

Figure 1:
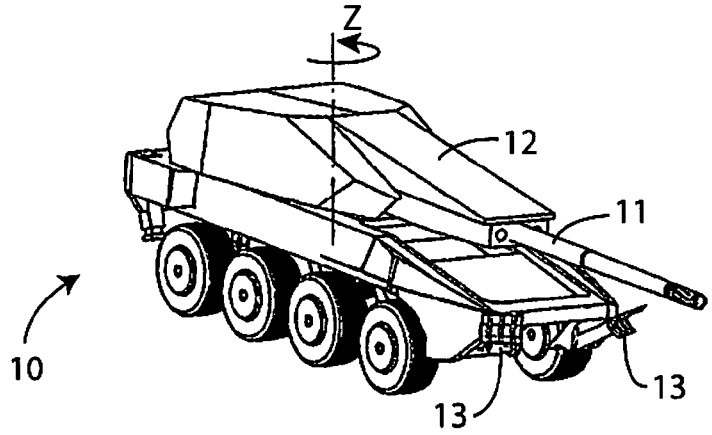
FIGS. 1-3 illustrate a combat vehicle provided with a cannon operated through an artillery ammunition loading system according to the present invention in four different operating configurations.
Figure 2:
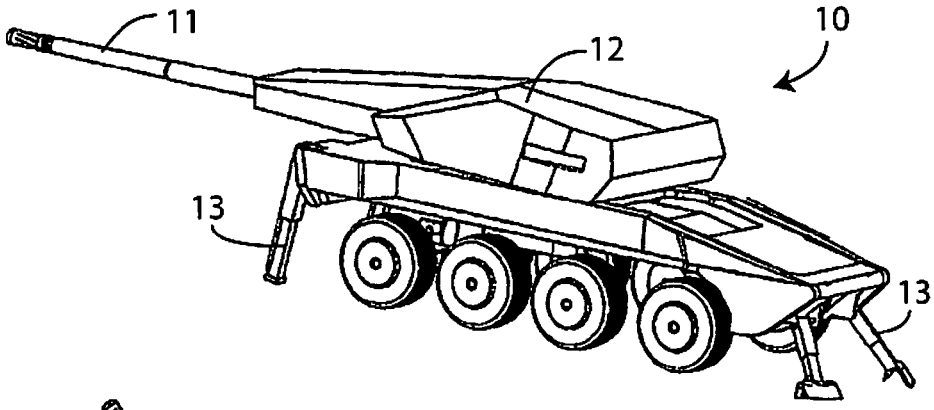
Figure 3:
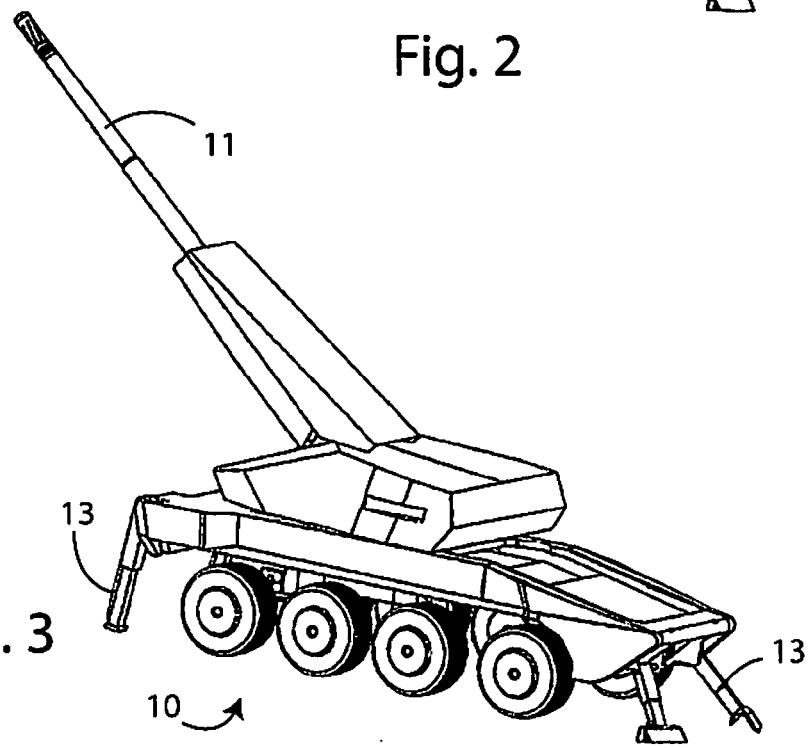

With reference to FIGS. 1-3, number 10 indicates a combat vehicle as a whole, which comprises a cannon or howitzer 11, which is mounted on a turret 12 that rotates around its rotation axis Z; cannon or howitzer 11, furthermore, can be adjusted in its elevation, i.e. its firing elevation angle, with respect to the attitude of combat vehicle 10.

Combat vehicle 10 comprises, furthermore, a plurality of firing stabilization means 13, which are arranged in correspondence to its front end and its rear end and, in the above-mentioned figures, comprise four legs, two front legs and two rear legs, which can be respectively retracted and lowered during the ride and during the firing operations.

FIG. 1, in detail, illustrates a riding configuration of combat vehicle 10, in which the vehicle is ready to move on the ground, while cannon or howitzer 11 is in a rest configuration (with recoiled mass), in which it is typically turned towards the front part of combat vehicle 10 itself.

FIG. 2 illustrates combat vehicle 10 in a configuration in which the turret is being moved towards a firing configuration; in this configuration turret 12 is rotated and firing stabilization means 13 are lowered, thus coming in contact with the ground, so that the entire vehicle has such a statically indeterminate stabilization that guarantees the substantial immobility during firing.

FIG. 3 illustrates the combat vehicle in a firing configuration, in which cannon or howitzer 11 is turned upwards with an elevation angle that varies as a function of the distance of the target to be hit and of the range of the ammunition.

On the side of cannon or howitzer 11 there is a pair of elevation linear actuator means 203, which are able to move cannon or howitzer 11 and cause it to rotate so as to vary its inclination with respect to the hull (elevation adjustment).

In particular, the ammunitions that can be fired by combat vehicle 10, and, therefore, can be handled by the artillery ammunition loading system, can be ammunitions of the traditional type, namely of the type comprising a projectile and a propelling charge that, in use, is inserted into the breech of the cannon or howitzer 11 following the projectile itself or, alternatively, ammunitions of a different type, such as, for example, HEFSDS ammunitions (High Explosives Fin Stabilized Discarding Sabot), which basically are subcaliber, non self-propelled ammunitions having a guided version comprising aerodynamic controls, inertial/GPS navigation and, in some sub-types, a terminal guidance system.

Figure 4:
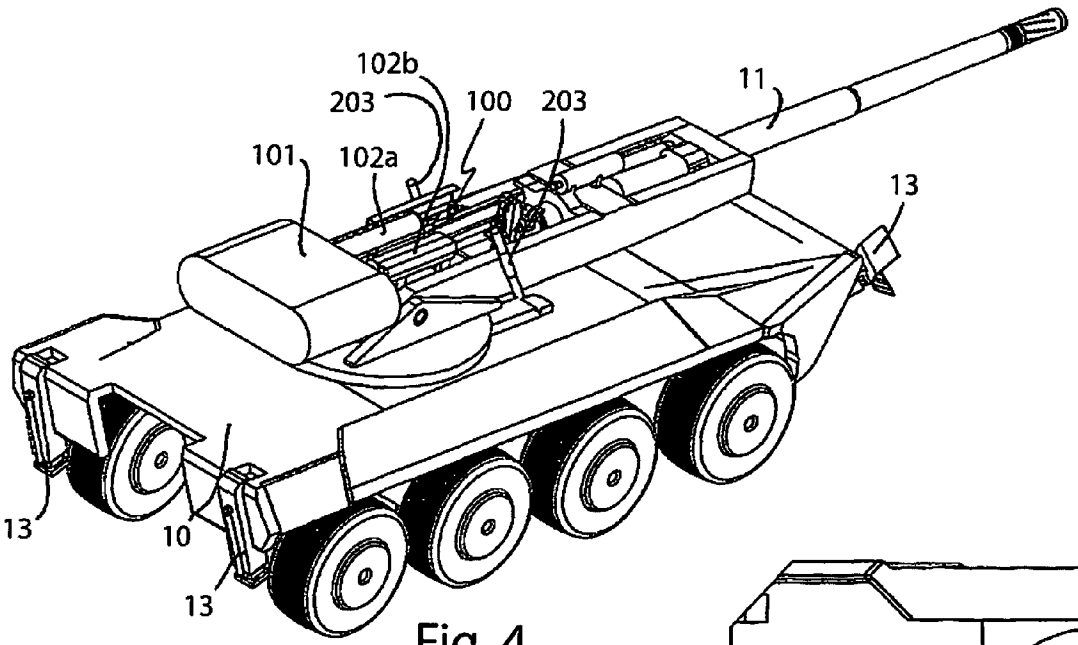
FIG. 4 illustrates a prospective view of an ammunition loading system according to the present invention.

FIG. 4 illustrates a detail of the inside of the turret that houses an artillery ammunition loading system 100: said system comprises:

- a projectile magazine 101, which is substantially arranged aligned with a longitudinal axis of the cannon or howitzer 11;
- a first mobile projectile loading means 102*a*, or projectile loading ladle, and a second mobile propelling charge loading means 102*b*, or propelling charge loading ladle, which are mobile in a sliding manner along an axis that is parallel to a longitudinal axis of cannon or howitzer 11;
- linear actuator means 103, which are configured to cause the first mobile projectile loading means 102*a* and the second mobile propelling charge loading means 102*b* to move along an axis that is transverse or orthogonal to the above-mentioned longitudinal axis of cannon or howitzer 11.

For each firing cycle, the first and the second mobile means, respectively suited to load projectiles and propelling charges of the ammunition, selectively and at least partially automatically feed said cannon or howitzer 11.

Figure 5:
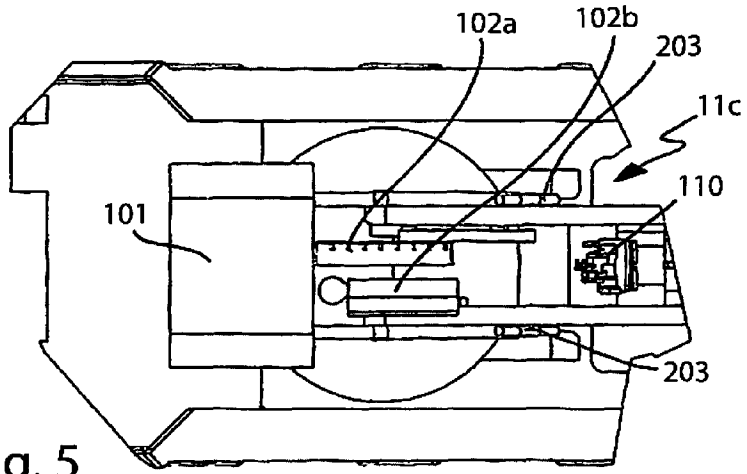
FIG. 5 illustrates, in a plan view, a detail of an artillery ammunition loading system according to the present invention.

In detail, as shown in FIG. 5, both the first mobile projectile loading means 102*a* and the second mobile propelling charge loading means 102*b* are mounted so as to slide on a support and, by so doing, they slide parallel to each other between a first pick-up position respectively of a projectile or of a propelling charge of an artillery ammunition and a position corresponding to a breech 11*c* of cannon or howitzer 11, which presents an open position and a closed position.

In the open position, breech 11*c* allows the projectile and, subsequently, the propelling charge of the ammunition to enter the carriage of the cannon or howitzer 11, while, in the closed position, breech 11*c* allows the ammunition itself to be fired, with the consequent outlet of the projectile from a muzzle 11*v* of the cannon or howitzer 11.

Figure 6:
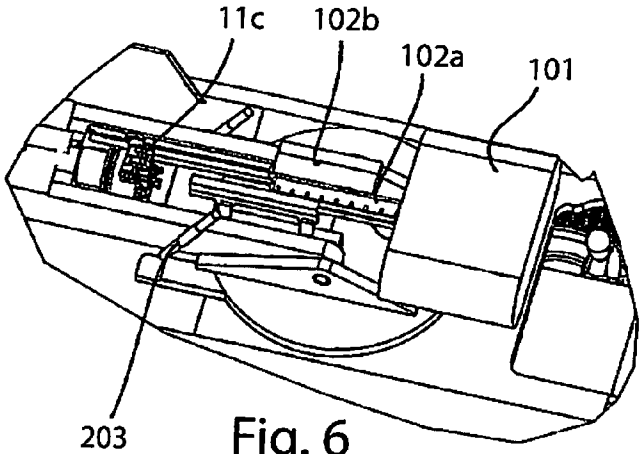

The loading procedure needed to load a projectile comprises a first step, during which, as shown in FIG. 6, the first mobile projectile loading means 102*a* is arranged in a first extreme position in correspondence to projectile magazine 101, from which the projectile is drawn. Therefore, the projectile is housed in the body of the first mobile projectile loading means 102*a*, which is suited to house the projectile itself, since it is hollow and presents a substantially cylindrical shape.

During the first step, the second mobile propelling charge loading means 102*b* is arranged in an extreme position as well, which is opposite to the position of breech 11*c*.

During the first step, the first mobile projectile loading means 102*a* is arranged in a position which is misaligned with respect to the longitudinal axis of the cannon or howitzer 11

Figure 7:
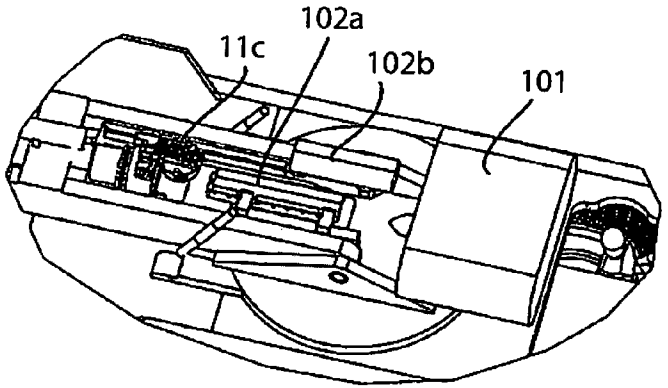
FIGS. 6-9 illustrate details concerning different operating configurations of the loading system that is the subject-matter of the present invention.
Figure 8:
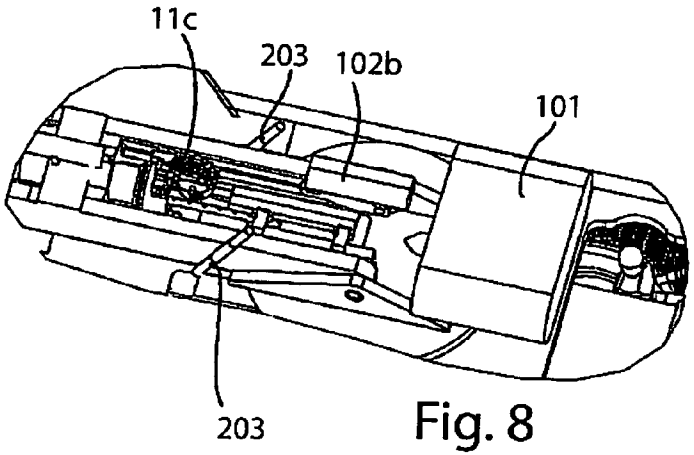

Subsequently, in a second step illustrated in FIG. 7, ladle 11*c* opens and the projectile is inserted into it. In order to do so, the first mobile projectile loading means 102*a* is caused to slide on its support and, simultaneously, it is translated along a direction that is transverse to the direction determined by its stroke on the support, this translation being carried out by means of linear actuator means 103, until the above-mentioned means reaches a position that is aligned with the longitudinal axis of cannon or howitzer 11 and until it reaches, in a third step, a second extreme position, opposite to the first one, in which the first mobile projectile loading means 102*a* reaches a substantial proximity to breech 11*c* of cannon or howitzer 11, so as to insert the projectile into the carriage of cannon or howitzer 11, FIG. 8.

Figure 9:
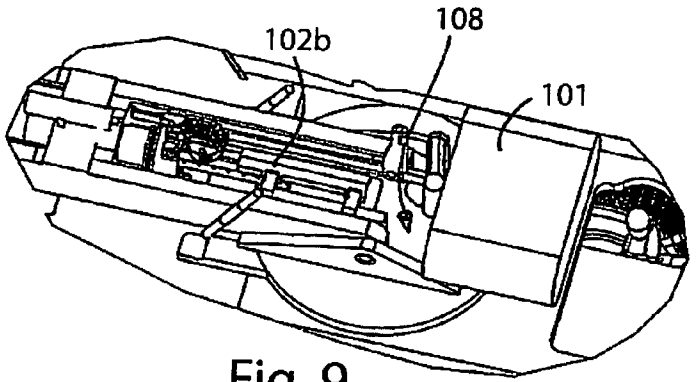

Subsequently, in a fourth step shown in FIG. 9, the second mobile propelling charge loading means 102*b* picks up a propelling charge from a propelling charge magazine 108. In order to do so, the second mobile propelling charge loading means 102*b* is caused to rotate in correspondence to the first extreme position, so as to fall into line with a propelling charge that is vertically housed in propelling charge magazine 108, which is arranged at a lower height with respect to projectile magazine 101.

Figure 10:
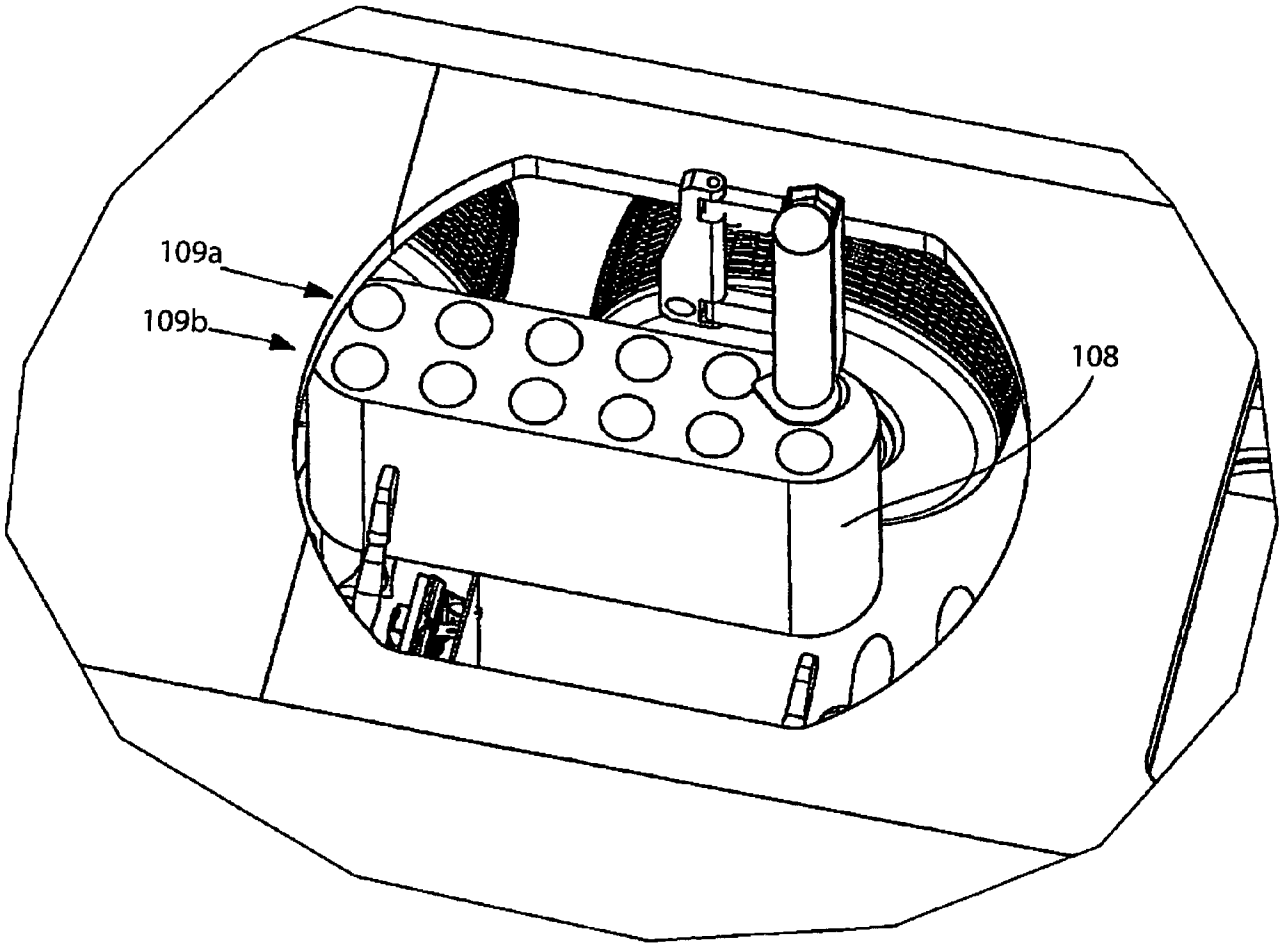
FIG. 10 illustrates a detail of a part of a magazine of propelling charges for ammunitions loaded by the system that is the subject-matter of the present invention.

As shown in FIG. 10, propelling charge magazine 108 comprises a plurality of rows 109*a*, 109*b* of holes, which are parallel to each other and are designed to house a plurality of propelling charges.

After the propelling charge has been picked up, the second mobile propelling charge loading means 102*b* is rotated again and translated parallel to a longitudinal axis of cannon or howitzer 11, until it reaches the second extreme position in substantial vicinity to the breech, in order to be then translated by linear actuator means 103 to a position in correspondence to the axis of cannon or howitzer 11, so as to allow the propelling charge to be inserted after the projectile.

Now the ammunition loading procedure is completed and breech 11*c* can be closed to start the firing procedure.

The system according to the present invention, furthermore, is managed by a numerical subsystem, which controls the automated operations for the loading of the ammunition described above. Said numerical subsystem can rely on a data processing unit, which, if necessary, can be redundant and which is suited to process, besides the automated operations for the loading of the ammunitions, ballistic and shooting solutions, as well as data exchange concerning operations for the exchange of operating, tactical and logistic information coming from one or more vehicles or men operating on the battle field and, therefore, knowing the exact position of the enemy forces as well as the sources of possible threats.

The advantages of the system according to the present invention are known in the light of the above description. In particular, it allows the person responsible of the weapon to remain inside of the hull, thus placing him/her in a safer position.

Furthermore, the system according to the present invention also guarantees a higher firing rapidity, due to the fact that the loading operations of the projectile and of the propelling charge are automated.

Finally, the loading system according to the present invention also allows both the projectiles and the propelling charges to be loaded with the same effectiveness independently from the variations made to the elevation angle of cannon or howitzer 11.

The device described above can be subject to variations that are obvious to a person skilled in the art, without in this way going beyond the scope of protection provided by the accompanying claims.

The invention claimed is:

1. An artillery ammunitions loading system, configured for loading ammunitions comprising at least a projectile in a cannon or a howitzer; said ammunitions loading system comprises a first mobile loader for loading projectiles and a second mobile loader for loading a propelling charge alternatively and at least partially automatically supplying said cannon or howitzer for each firing cycle;

said first mobile loader and said second mobile loader being slidably movable along an axis parallel to a longitudinal axis of the cannon or howitzer between a first position and a second position;

a linear actuator for moving said first mobile loader and said second mobile loader along an axis transverse or orthogonal to the longitudinal axis of the cannon or howitzer;

said second mobile loader rotating in correspondence to a first extreme position to align with a propelling charge, and back.

2. The artillery ammunitions loading system according to claim 1, wherein said first mobile loader for loading projectiles and said second mobile loader for loading propelling charges have respectively a first position misaligned with respect to a longitudinal axis of said cannon or howitzer and a second position aligned with said longitudinal axis.

3. The artillery ammunitions loading system according to claim 1, wherein movement between said first position and said second position occurs by said linear actuator.

4. The artillery ammunitions loading system according to claim 1, wherein the system permits the loading of said ammunitions within said cannon or howitzer independently from an elevation angle acquired by said cannon or howitzer.

* * * * *